US006646380B1

(12) United States Patent
Kubon et al.

(10) Patent No.: US 6,646,380 B1
(45) Date of Patent: Nov. 11, 2003

(54) HIGH-PRESSURE GAS DISCHARGE LAMP

(75) Inventors: Marcus Kubon, Aachen (DE); Hermann Krautzberger, Alsdorf (DE); Joseph Franciscus Raymond Eijsermans, Eindhoven (NL); Dorothea Seebode, Aachen (DE)

(73) Assignee: U.S. Philips Corporation, New York, NY (US)

( * ) Notice: Subject to any disclaimer, the term of this patent is extended or adjusted under 35 U.S.C. 154(b) by 406 days.

(21) Appl. No.: 09/718,245

(22) Filed: Nov. 22, 2000

(30) Foreign Application Priority Data

Nov. 30, 1999 (DE) ..... 199 57 561

(51) Int. Cl.[7] ..... H01J 61/04

(52) U.S. Cl. ..... 313/631; 313/634; 313/623; 313/573

(58) Field of Search ..... 313/631, 632, 313/634, 637, 623, 567, 573, 326, 331, 332

(56) References Cited

U.S. PATENT DOCUMENTS

| | | | | | |
|---|---|---|---|---|---|
| 4,806,816 | A | * | 2/1989 | de Vrijer | 313/331 |
| 5,404,077 | A | * | 4/1995 | Eichelbronner et al. | 313/623 |
| 6,169,365 | B1 | * | 1/2001 | Kubon et al. | 313/631 |
| 6,194,832 | B1 | * | 2/2001 | Juengst | 313/625 |
| 6,201,349 | B1 | * | 3/2001 | Pfaffel | 313/631 |
| 6,307,321 | B1 | * | 10/2001 | Honda et al. | 313/634 |
| 6,368,175 | B1 | * | 4/2002 | Horiuchi et al. | 445/26 |
| 6,534,918 | B1 | * | 3/2003 | Peterek et al. | 313/631 |

FOREIGN PATENT DOCUMENTS

| | | | |
|---|---|---|---|
| WO | WO9837570 | 8/1998 | H01J/61/073 |
| WO | WO9837571 | 8/1998 | H01J/61/073 |

* cited by examiner

*Primary Examiner*—Robert H. Kim
*Assistant Examiner*—Jurie Yun

(57) ABSTRACT

Tungsten electrodes are arranged on two rhenium rods in an electrode chamber in a high-pressure gas discharge lamp, such that the rhenium rods project to inside the electrode chamber.

14 Claims, 1 Drawing Sheet

HIGH-PRESSURE GAS DISCHARGE LAMP

Figure 1:
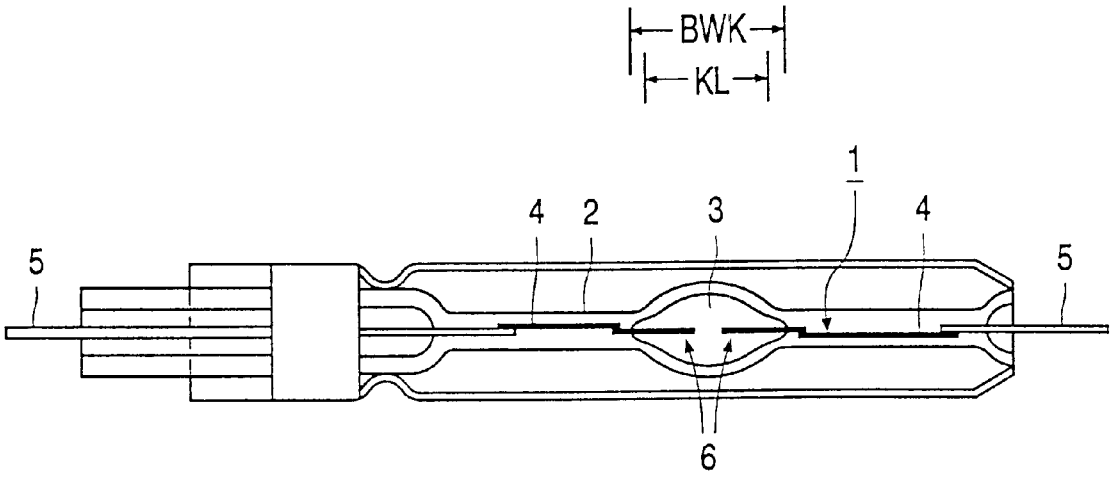

The invention relates to a high-pressure gas discharge lamp with two tungsten electrodes which are each held in an electrode chamber by means of a support and which have a diameter of below 500 $\mu$m.

Similar high-pressure gas discharge lamps are disclosed, for example, in WO 98/37570 A1 and WO 98/37571 A1. In these lamps, two tungsten electrodes, each also surrounded by a tungsten wire, project into an electrode chamber, supported by substantially freely projecting supports. The supports, which consist of or comprise rhenium in these publications, are in contact with the wall of the electrode chamber at a location denoted "bottom of the electrode chamber". The electrode chamber is also sealed in this location. This is achieved by means of a metal foil which is connected to a respective support and a current supply wire and onto which the material forming the electrode chamber is pinched.

Of a completely different type, however, are high-pressure gas discharge lamps in which the tungsten electrodes have a diameter of less than 500 $\mu$m or in which the bulb length, i.e. the distance between the bottom points of a wall forming the electrode chamber is less than 15 mm. The electrode chamber seals and the electrode chamber bottoms in such high-pressure gas discharge lamps lie in different positions. The electrode chamber bottom is here removed by up to several millimeters from the seals on the metal foil.

It is an object of the present invention to achieve that high-pressure gas discharge lamps with two tungsten electrodes, which are each arranged at supports in an electrode chamber and have a diameter of below 500 $\mu$m, can be operated with a sufficiently long useful life.

To achieve this object, the invention proposes a high-pressure gas discharge lamp as described above, wherein at least one of the tungsten electrodes is entirely accommodated in the electrode chamber.

It was found that the useful life of the electrode assemblies formed from the support and the tungsten electrode can be substantially improved when the tungsten electrode is entirely arranged in the electrode chamber. Although the support as well as the tungsten electrode is substantially freely arranged also between the seal and the electrode chamber bottom, because the actual sealing of the electrode chamber takes place only behind the contact point of the support facing away from the tungsten electrode, a tungsten electrode extending from the electrode chamber to behind the electrode chamber bottom is subject to an increased wear. This can be avoided by a free arrangement of the tungsten electrode in the electrode chamber.

If on the other hand the electrode chamber is in contact with at least one support at a contact spot, and not at an electrode chamber bottom, the possibility is given that a sufficient convection takes place around the tungsten electrode, which enables a long useful life of the lamp.

It is of particular advantage when the sum of the electrode interspacing and the interspacings between the electrode tips and the respective electrode chamber bottoms divided by the electrode interspacing has a value of between 1.6 and 3. Such an arrangement safeguards on the one hand an advantageous generation of a temperature gradient over the electrode assembly comprising the tungsten electrode and the support as well as a sufficient convection around this electrode assembly, whereby a long useful life can be guaranteed.

Preferably, at least one support comprises a rhenium sheath or is formed by a rhenium rod. It is advantageous here when the rhenium content of the sheath or rod does not fall below 25% by weight. Such an arrangement is particularly suitable for high-pressure gas discharge lamps which contain a gas filling substantially composed of metal oxyhalides during operation. The electrode chamber in this case may comprise, for example, a mixture of NaI, $SnI_2$, NaBr, TlBr, $HgI_2$, and/or $WO_3$. In addition, mercury, oxygen, and argon or a different rare gas may be provided in the electrode chamber. The oxygen, or the $WO_3$ as an oxygen provider, serves to form oxyhalides here.

Preferably, the tungsten electrode is welded on the support. Such a connection can be prepared in a reliable way also in very small dimensions. This is true in particular in relation to the use of rhenium.

It is particularly difficult, especially in the case of small lamp dimensions, to safeguard that the tungsten electrode is present in its entirety in the electrode chamber. This is true in particular with respect to an industrial manufacture and the tolerances inherent therein. It is suggested, therefore, that the electrode chamber in at least a cross-sectional plane has a tapering shape towards at least one electrode or towards at least one support, the taper gradient in the tapering direction passing through a real minimum up to a contact spot or an electrode chamber bottom. Such a construction of the electrode chamber can guarantee an artificial lengthening of the electrode chamber in the region of the electrode chamber bottom, which lengthening extends away from the tungsten electrode. It can be reliably achieved by means of such a lengthening that the tungsten electrode lies in its entirety in the electrode chamber.

This can be safeguarded in practice in that in the manufacture of the high-pressure gas discharge lamp, during which the lamp body is molded into shape and the gas-filled electrode chamber is formed with its electrodes projecting from the electrode chamber bottoms into the electrode chamber in the interior, this lamp body after its formation is subsequently widened in the region of at least one electrode chamber bottom. It is obvious in this case that also a fluent transition between the formation of the lamp body by molding and the subsequent widening may also be provided.

The lamp body may be heated in the region of the electrode chamber bottom for the purpose of widening. This safeguards a particularly simple manufacture of the respective lamp.

It is obvious that a taper gradient which passes through a real minimum and a relevant manufacturing process may also be advantageously utilized independently of the other characteristics of the high-pressure gas discharge lamp, in particular independently of the type of electrodes, so as to be able to manufacture sufficiently freely exposed electrodes also in small lamps, in particular also under mass manufacturing conditions. Lamps can be manufactured in this manner in particular whose bulb length is shorter than the inner-wall chamber, i.e. than the sum of the electrode interspacing and the distances between the electrode tips and the respective electrode chamber bottoms.

Figure 2:
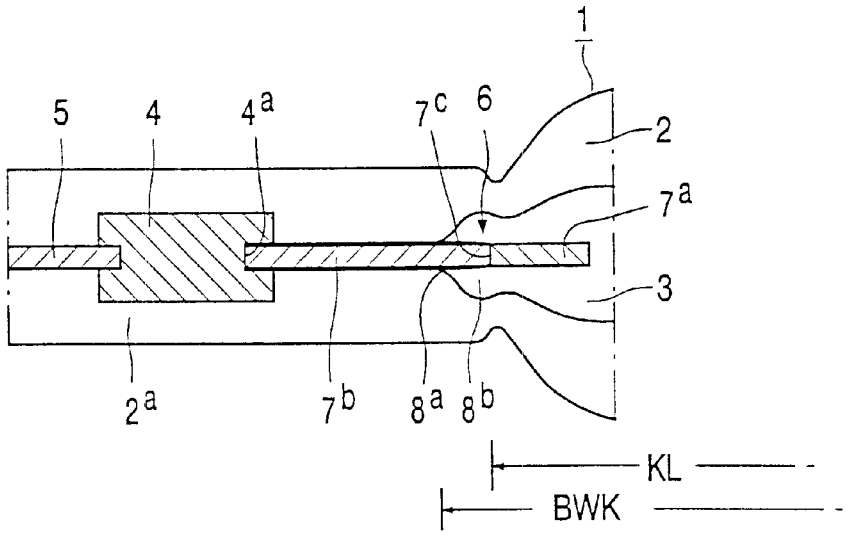

Further objects, advantages, and characteristics of the present invention will be explained in more detail in the ensuing description of the drawings, in which a high-pressure gas discharge lamp according to the invention is shown by way of example. In the drawings:

FIG. 1 shows a high-pressure gas discharge lamp according to the invention in a diagrammatic cross-sectional view, the cross-sectional plane being perpendicular to the seal plane, and FIG. 2 shows the lamp of FIG. 1 on a larger scale in a cross-sectional view perpendicular to the plane of the cross-section of FIG. 1.

The high-pressure gas discharge lamp shown in the Figures comprises a sealed glass body 1 of quartz glass. However, it may alternatively be made, for example, of monocrystalline or polycrystalline ceramic material. A wall 2 of quartz glass molded into shape encloses an electrode chamber 3 which is filled with a suitable mixture of xenon and mercury as well as various salts. The electrode chamber 3 is sealed at the level of metal foils 4, which are connected to respective supply lines 5 with electrical conduction.

Electrode assemblies 6 project from the metal foils 4 into the electrode chamber 3. The electrode assemblies 6 each consist of a tungsten electrode 7*a* and a support 7*b*. The support 7*b* is a rhenium rod on which the tungsten electrode 7*a* is welded in a transition spot 7*c*. As is immediately visible from FIG. 2, the tungsten electrode 7*a* lies in its entirety in the electrode chamber 3. At the opposite end, the support 7*b* is connected to the foil 4 in a spot 4*a* with electrical conduction.

The supports 7*b* enter the electrode chamber 3 at respective contact spots 8*a*. Such a spot is usually denoted "electrode chamber bottom". A bead-shaped recess 8*b* immediately adjoins the electrode chamber bottom 8*a*, before the actual electrode chamber 3 starts. As is evident from FIG. 2, the electrode chamber 3 thus tapers starting from the tungsten electrode 7*a* towards the support 7*b*, the taper gradient in the tapering direction passing through a real minimum exactly at the recess 8*b*. Since the electrode chamber 3 in this location even becomes wider again in the present embodiment, the taper gradient is negative in this region.

As is immediately visible, the inner-wall chamber (BWK), which represents the sum of the electrode interspacing (EA) and the distances (PBA) between the electrode tips and the respective electrode chamber bottoms, is greater than the bulb length (KL) of the lamp.

In the present embodiment, the electrode interspacing is approximately 4 mm and the distance between one electrode tip and the respective electrode chamber bottom is approximately 1.3 mm. It follows from this that the sum of electrode interspacing and the distances between the electrode tips and the respective electrode bottoms divided by the electrode interspacing has a value of 1.65.

It is obvious that such an arrangement in which the inner-wall chamber is greater than the bulb length and/or an arrangement in which a taper gradient passes through a real minimum is advantageous also independently of the other characteristics of such a high-pressure gas discharge lamp and opens up a new dimension in the freedom of design for the construction of such lamps.

What is claimed is:

1. A high-pressure gas discharge lamp with two tungsten electrodes which are each held in an electrode chamber by means of a support and which have a diameter of below 500 $\mu$m, wherein in at least one of the tungsten electrodes and its respective support, tungsten is present only in the at least one of the tungsten electrodes and said at least one of the tungsten electrodes is entirely accommodated in the electrode chamber.

2. A high-pressure gas discharge lamp as claimed in claim 1, wherein the electrode chamber is in contact with at least one support in a contact spot.

3. A high-pressure gas discharge lamp as claimed in claim 1, wherein at least one support comprises a rhenium sheath.

4. A high-pressure gas discharge lamp as claimed in claim 1, wherein at least one support comprises a rhenium rod.

5. A high-pressure gas discharge lamp as claimed in claim 1, wherein the tungsten electrode is welded onto the support.

6. A high-pressure gas discharge lamp as claimed in claim 1, wherein the electrode chamber in at least a cross-sectional plane has a tapering shape towards at least one electrode or towards at least one support, the taper gradient in the tapering direction passing through a real minimum up to a contact spot or an electrode chamber bottom.

7. A high-pressure gas discharge lamp with two tungsten electrodes which are each held in an electrode chamber by means of a support and which have a diameter of below 500 $\mu$m, wherein at least one of the tungsten electrodes is entirely accommodated in the electrode chamber;

the electrode chamber is in contact with each of the supports at a respective chamber bottom; and the sum of the electrode interspacing (EA) and the interspacings between the electrode tips and the respective electrode chamber bottoms divided by the electrode interspacing (EA) has a value of between 1.6 and 3.

8. A high-pressure gas discharge lamp with two tungsten electrodes which are each held in an electrode chamber by means of a support and which have a diameter of below 500 $\mu$m, wherein at least one of the tungsten electrodes is entirely accommodated in the electrode chamber;

the electrode chamber is in contact with each of the supports at a respective chamber bottom; and a bulb having a bulb length (KL) encloses the electrode chamber in which at each electrode chamber bottom an electrode assembly projects into the interior, while the bulb length (KL) is smaller than the sum of the electrode interspacing (EA) and the distances (PBA) between the electrode tips and the respective electrode chamber bottoms.

9. A high-pressure gas discharge lamp comprising an electrode chamber and two tungsten electrodes having a diameter below 500 $\mu$m, at least one of the tungsten electrodes being held in the electrode chamber by a support of a material different from the material of the at least one tungsten electrode, the support being in contact with a wall of the electrode chamber at an electrode chamber bottom, wherein the at least one tungsten electrode is entirely accommodated in the electrode chamber, the electrode chamber having a seal on the support on a side of the electrode chamber bottom facing away from the at least one tungsten electrode.

10. A high-pressure gas discharge lamp as claimed in claim 9, wherein at least one of the supports comprises a rhenium sheath.

11. A high-pressure gas discharge lamp as claimed in claim 9, wherein at least one of the supports comprises a rhenium rod.

12. A high-pressure gas discharge lamp as claimed in claim 9, wherein the at least one tungsten electrode is welded onto the respective support.

13. A high-pressure gas discharge lamp having an electrode chamber and two tungsten electrodes, each of the electrodes having a diameter less than 500 $\mu$m and being held in the electrode chamber by a support, one or both of the tungsten electrodes being entirely accommodated in the electrode chamber, the electrode chamber tapering toward at least one of the electrodes or toward a respective at least one of the supports, the tapering having a varying gradient between the at least one of the electrodes and an electrode chamber bottom where the electrode chamber meets the respective at least one of the supports, the gradient passing through a minimum and determining a lengthening of the electrode chamber.

14. A high-pressure gas discharge lamp with two electrodes, each said electrode having a diameter less than 500 μm and being held in an electrode chamber by means of a support, wherein substantially all of at least one of the electrodes is exposed in the electrode chamber;

the electrode chamber is in contact with each of the supports at a respective electrode chamber bottom and has an inner-wall chamber length (BWK) equal to the sum of the electrode interspacing (EA) and the interspacings between the electrode tips and the respective electrode chamber bottoms;

the electrode chamber comprises a bulb extending a bulb length (KL) from an end of the at least one electrode attached to the respective support of the at least one electrode to an end of the other electrode attached to the respective support of the other electrode, the electrode chamber tapers at a varying rate toward at least one of the electrode chamber bottoms, the gradient of the tapering decreasing over a portion of the distance from an end of one of said electrodes attached to the respective support and the at least one of the chamber bottoms, and KL is less than BWK.

* * * * *